US007699307B2

(12) United States Patent
Sasaki

(10) Patent No.: US 7,699,307 B2
(45) Date of Patent: Apr. 20, 2010

(54) MEDIUM DELIVERY APPARATUS AND MEDIUM PROCESSING APPARATUS WITH DUAL ROTATING PRESSING MEMBERS

(75) Inventor: Toshiyuki Sasaki, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/364,796

(22) Filed: Feb. 3, 2009

(65) Prior Publication Data

US 2009/0194929 A1 Aug. 6, 2009

(30) Foreign Application Priority Data

Feb. 6, 2008 (JP) ..... 2008-026018

(51) Int. Cl.
*B65H 1/08* (2006.01)

(52) U.S. Cl. ..... 271/127; 271/149; 271/160; 271/126

(58) Field of Classification Search ..... 271/149, 271/160, 126, 127
See application file for complete search history.

(56) References Cited

U.S. PATENT DOCUMENTS 5,088,718 A * 2/1992 Stepan et al. ..... 271/149
7,350,993 B2 4/2008 Hirabayashi
2005/0129441 A1* 6/2005 Hirabayashi ..... 399/405
2008/0067734 A1 3/2008 Hirabayashi
2008/0073828 A1 3/2008 Hirabayashi
2008/0211163 A1* 9/2008 Sasaki ..... 271/1

FOREIGN PATENT DOCUMENTS

JP 2004-206362 7/2004
JP 2005-161844 6/2005
JP 2008-201501 9/2008

* cited by examiner

*Primary Examiner*—Patrick H Mackey
*Assistant Examiner*—Gerald W McClain
(74) *Attorney, Agent, or Firm*—Nutter McClennen & Fish LLP; John J. Penny, Jr.; Rory P. Pheiffer

(57) ABSTRACT

A medium delivery apparatus, includes: a medium insertion portion; a medium delivery port; first and second medium guide surfaces; a feed roller; a first pressing member; a second pressing member; a rotating member; an urging member, configured to give an urging force acting in a first rotation direction to the rotating member to rotate the second pressing member toward the protruding position; an elastic member, configured to cause the second pressing member and the rotating member to abut against each other; and a stationary abutting portion, against which the rotating member abuts when the first pressing member is placed in the vicinity of the waiting position.

7 Claims, 10 Drawing Sheets

9
10a
21
22
22a
23
23a
25
25a
26a
26b
26d
27
27a
27b
27d
27A
27C
28
29a
32
33
34
34A
34e
35
36
37
38
26
(26A)
(26B)
(26C)

MEDIUM DELIVERY APPARATUS AND MEDIUM PROCESSING APPARATUS WITH DUAL ROTATING PRESSING MEMBERS

Priority is claimed to Japanese patent application No. 2008-026018 filed on Feb. 6, 2008, the disclosure of which, including the specification, drawings and claims, is incorporated herein by reference in its entirety.

BACKGROUND

1. Technical Field

The present invention relates to a medium delivery apparatus for separating and delivering media, such as checks and recording papers, sheet by sheet, and to a medium processing apparatus, such as a check processing apparatus, a printer, a scanner, and a magnetic reading apparatus, for delivering media, using the medium delivery apparatus.

2. Related Art

In financial institutions such as banks, checks (securities), such as a check or a bill, brought thereinto are put into a check processing apparatus to read images and magnetic ink characters printed on the front surface and the rear surface of the checks and to perform an operation of distributing the checks according to a result of reading the images and the magnetic ink characters. With the recent popularization of electronic payment, read image data and magnetic ink characters have been processed by computers to manage checks by computers. JP-A-2004-206362 discloses such a check processing apparatus.

In the check processing apparatus, checks are inserted into a check insertion portion in a stacked state and are delivered to a check delivery passage by a feed roller. A pressing member for pressing a check against the feed roller is placed in the check insertion portion.

A rotation-type member is employed as the pressing member, which is enabled to rotate around one end thereof to press a check against the feed roller at the other end thereof. The rotation-type pressing member is simple in structure and is highly reliable in operation, as compared with a parallel-movement-type pressing member.

The rotation-type pressing member presses only a check's portion that is opposed to an outer peripheral surface of the feed roller against the feed roller. Thus, the check is put into a state in which the check is not constrained in a stacking direction at the remaining portions thereof. Consequently, in a case where a check is creased at a leading end part thereof in a check delivering direction, the leading end portion of the check tends to unfold because the leading end portion thereof is not pressed. When the check is delivered from the check insertion portion via a delivery port having a narrow width, the check is likely to be caught in the delivery port. Thus, there is a concern that the check may be jammed therein.

Such an adverse effect can be avoided by completely pressing the check in the check insertion portion using a parallel-movement-type pressing member. However, as compared with the rotation-type pressing member, the parallel-movement-type pressing member is complex in the structure of a movement mechanism, and is large in the number of components. Thus, the parallel-movement-type pressing member is high in the manufacturing cost thereof, and is low in reliability.

In view of the above, in JP-A-2008-201501, a medium delivery apparatus enabled to surely deliver a sheet-shaped medium, such as a check, from a medium insertion portion using a rotation-type pressing member has been proposed. In the delivery apparatus disclosed in JP-A-2008-201501, a first pressing member that presses a sheet-shaped medium against the feed roller, and a second pressing member that presses a sheet-shaped medium's end portion in a delivering direction, are arranged. A sheet-shaped medium is delivered in a state in which the sheet-shaped medium is pressed by both the pressing members.

SUMMARY

An advantage of some aspects of at least one embodiment of the invention is to provide a medium delivery apparatus enabled to press a medium against a feed roller by appropriately moving first and second rotating pressing members.

According to an aspect of at least one embodiment of the invention, there is provided a medium delivery apparatus includes: a medium insertion portion, into which a medium is to be inserted; a medium delivery port, from which the medium inserted into the medium insertion portion is to be delivered; first and second medium guide surfaces, configured to be opposed to each other to guide the medium towards the medium delivery port; a feed roller, arranged at a side of the first medium guide surface to feed the medium inserted into the medium insertion portion towards the medium delivery port; a first pressing member, being rotatably supported around a first support shaft arranged at a side of the second medium guide surface, between a waiting position at a side of the second medium guide surface and a medium pressing position at which the first pressing member approaches or abuts against the feed roller; a second pressing member, being rotatably supported around a second support shaft attached to the first pressing member, between a retreating position to which the second pressing member retreats to a side of the first pressing member and a protruding position at which the second pressing member approaches or abuts against the first medium guide surface; and a rotating member, being rotatably supported around the second support shaft.

The medium delivery apparatus may further include an urging member, configured to give an urging force acting in a first rotation direction to the rotating member to rotate the second pressing member toward the protruding position; an elastic member, configured to cause the second pressing member and the rotating member to abut against each other such that the second pressing member and the rotating member rotate together; and a stationary abutting portion, against which the rotating member abuts when the first pressing member is placed in the vicinity of the waiting position. When the first pressing member is placed at the waiting position, the rotating member abuts against the stationary abutting portion and rotates in a direction opposite to the first rotation direction to be spaced at a distance from the second pressing member.

In the medium delivery apparatus of at least one embodiment of the invention, when the first pressing member is rotated from the waiting position to the medium pressing position, the second pressing member is rotated by an urging force of the urging member from the retreating position to the protruding position interlockingly with this rotation of the first processing member. Accordingly, media having the leading end portion of each of which is creased, can be pressed against the first medium guide surface in a state in which the leading end portions thereof are aligned with one another by suitably setting the pressing position due to the second pressing member. Consequently, media to be fed by the feed roller can surely be delivered from the delivery port having a small width.

Further, in the medium delivery apparatus according to at least one embodiment of the invention, the rotating member is forcibly rotated in a direction opposite to the first rotation direction by a predetermined amount in a state in which the first pressing member is placed in the vicinity of the waiting position. Thus, the rotating member is spaced from the second pressing member at a predetermined distance. This spacing of the predetermined distance results in that even in a case where there is variation in the waiting position of the first pressing member, the second pressing member has already reached the retreating position due to the predetermined distance before the first pressing member reaches the waiting position. Thus, the second pressing member can surely retreat to the retreating position. Furthermore, when the first pressing member is rotated from the waiting position to the medium pressing position, the rotating member returns in the first rotation direction.

When the rotating member is rotated in the first rotation direction, the rotating member approaches the second pressing member and returns to an abutting state in which the rotating member abuts against the second pressing member. When the rotating member is in the abutting state, both the rotating member and the second pressing member can rotate in an integrated manner.

Further, a time at which the rotating member abuts against the second pressing member is also that at which the rotating member is disengaged from the stationary abutting portion. When the rotating member is disengaged from the stationary abutting portion, the rotating member is freely rotated in the first rotation direction. Thus, the rotating member is rotated in the first rotation direction by an urging force of an urging member, which acts upon the rotating member. After the rotating member abuts against the second pressing member, the second pressing member is rotated in the first rotation direction together with the rotating member by the urging force of the urging member to the protruding position.

A time after the first pressing member starts moving from the waiting position to the medium pressing position, i.e., the time at which the rotating member abuts against the second pressing member, the second pressing member starts moving from the retreating position to the protruding position. Accordingly, the time at which the second pressing member starts moving from the retreating position to the protruding position can be changed by changing the time point at which the rotating member abuts against the second pressing member.

Further, in an operation of returning the first pressing member from the medium pressing position to the waiting position, the second pressing member and the rotating member first move as the first pressing member moves. Incidentally, at that time, the second pressing member remains in a protruding state in which the second pressing member is protruded from the first pressing member by the urging force of the urging member. The rotating member abuts against the stationary abutting portion when the first pressing member is at a position on the way from the medium pressing position to the waiting position. Subsequently, the rotating member is forcibly rotated in a direction opposite to the first rotation direction as the first pressing member returns to the waiting position. Consequently, the second pressing member starts rotating to the retreating position together with the rotating member.

When the second pressing member reaches the retreating position, the second pressing member abuts against the first pressing member and is not further rotated. On the other hand, the rotating member, which abuts against the stationary abutting portion, rotates in a direction opposite to the first rotation direction as the first pressing member rotates to the waiting position. Thus, the rotating member is disengaged from the second pressing member. The first pressing member returns to the waiting position after the rotating member is apart from the second pressing member by a predetermined distance.

Thus, after the second pressing member returns to the retreating position at the side of the first pressing member, the rotating member further rotates interlockingly with a returning operation of the first pressing member. Accordingly, even in the case of causing variation in the waiting position of the first pressing member, this variation is absorbed by a rotation amount of the rotating member (i.e., the predetermined distance). Thus, the second pressing member can always be returned to the retreating position at the side of the first pressing member. Consequently, even in the case of occurrence of variation in the waiting position of the first pressing member, the second pressing member does not remain in a state in which the second pressing member is protruded into the medium insertion portion from the side of the first pressing member. Accordingly, the second pressing member does not become an obstacle when a medium is inserted into the medium insertion portion. The width of the medium insertion portion is not reduced by arranging the second pressing member in the apparatus. Thus, the number of media, which are accommodated in the apparatus, can be assured.

Incidentally, it is preferable that after the first pressing member moves to the medium pressing position so as to form a state in which a medium is sandwiched between the first pressing member and the feed roller, the second pressing member reaches the protruding position so as to form a state in which the medium is pressed against the first medium guide surface. First, a medium is pressed by the first pressing member against the feed roller to thereby form a state in which the medium is surely pressed against an outer peripheral surface of the feed roller. Thus, an operation of delivering a medium can surely be performed. Further, after media are aligned with one another by holding a central portion of each of the media, spread leading end portions thereof are held. Consequently, the spread leading end portions of the media can surely be aligned with one another.

Further, an embodiment of the medium delivery apparatus of the invention is configured so that: the first pressing member is provided with a first abutting portion against which the second pressing member can abut, and the retreating position of the second pressing member is determined by the first abutting portion; the rotating member includes: a first engaging arm extending in a delivering direction, in which the medium is delivered, around the second support shaft; and a second engaging arm extending in a direction opposite to the delivering direction; and the second pressing member is provided with a second abutting portion against which the first engaging arm of the rotating member can abut when the first engaging arm is rotated in the first rotation direction; the urging member is a tension coil spring laid between the rotating member and the first pressing member in a tension state; and the elastic member is a torsion coil spring wound around the second support shaft, and one end of the torsion coil spring is latched onto the rotating member and the other end thereof is latched onto the second pressing member.

The time at which the second pressing member starts moving from the retreating position to the protruding position can simply be adjusted by adjusting the lengths of the first engaging arm and the second engaging arm, or the positions of the second abutting portion and the stationary abutting portion.

Next, an embodiment of the medium delivery apparatus of the invention is featured by including a drive mechanism configured to rotate the first pressing member to the waiting position and the medium pressing position, and is featured in that the drive mechanism accelerates a movement speed of the first pressing member when the first pressing member moves from the waiting position to the medium pressing position.

For example, an embodiment of the medium delivery apparatus of the invention is featured in that the drive mechanism rotates the first pressing member at a first speed when the rotating member abuts against the stationary abutting portion, and the drive mechanism accelerates the movement speed of the first pressing member to a second speed after the rotating member is disengaged from the stationary abutting portion.

A medium inserted into the medium insertion portion is laid obliquely on the first medium guide surface on which the feed roller is arranged. In a case where the first pressing member is moved at a high speed from the side of the second medium guide surface to the medium having been in this state and presses the medium towards the first medium guide surface, sometimes, the medium having been laid obliquely thereon is pressed obliquely and upwardly against the feed roller in a wholly floated-up state by maintaining a posture thereof. Such a state causes a magnetic-ink-character reading failure.

According to at least one embodiment of the invention, when the first pressing member is moved from the waiting position to the medium pressing position, the first pressing member is initially moved at a first speed that is a low speed. Then, the first pressing member is moved at a second speed that is a high speed. The medium having been obliquely laid thereon is pressed at the low speed against the first medium guide surface. Thus, the medium is erected by the first pressing member into a vertically standing state without being floated up. Subsequently, the medium having been in the vertically standing state is pressed at a high speed against the first medium guide surface. Accordingly, the medium can efficiently be pressed against the feed roller without causing the floating-up of the medium.

At least one embodiment of the invention relates to a medium processing apparatus which is featured by including the medium delivery apparatus of the aforementioned configuration. The medium processing apparatus according to the invention can deliver a medium, which is inserted into the medium insertion portion, from the medium delivery port in a stable state. Consequently, the medium processing apparatus according to at least one embodiment of the invention can efficiently process a medium.

The medium delivery apparatus according to at least one embodiment of the invention is adapted so that a medium inserted into the medium insertion portion is pressed by the first pressing member against the feed roller, that in addition, the medium inserted into the medium insertion portion is pressed by the second pressing member against the first medium guide surface, and that the second pressing member is pressed against the medium by being operated with timing differing from that with which the first pressing member is operated. Accordingly, a medium can be pressed against the first medium guide surface by the second pressing member with optimal timing. Consequently, a medium can be delivered from the medium delivery port by the feed roller without jam.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a sheet-shaped medium processing apparatus provided with a sheet-shaped medium delivery device, is described with reference to the accompanying drawings.

(Overall Configuration)

Figure 1:
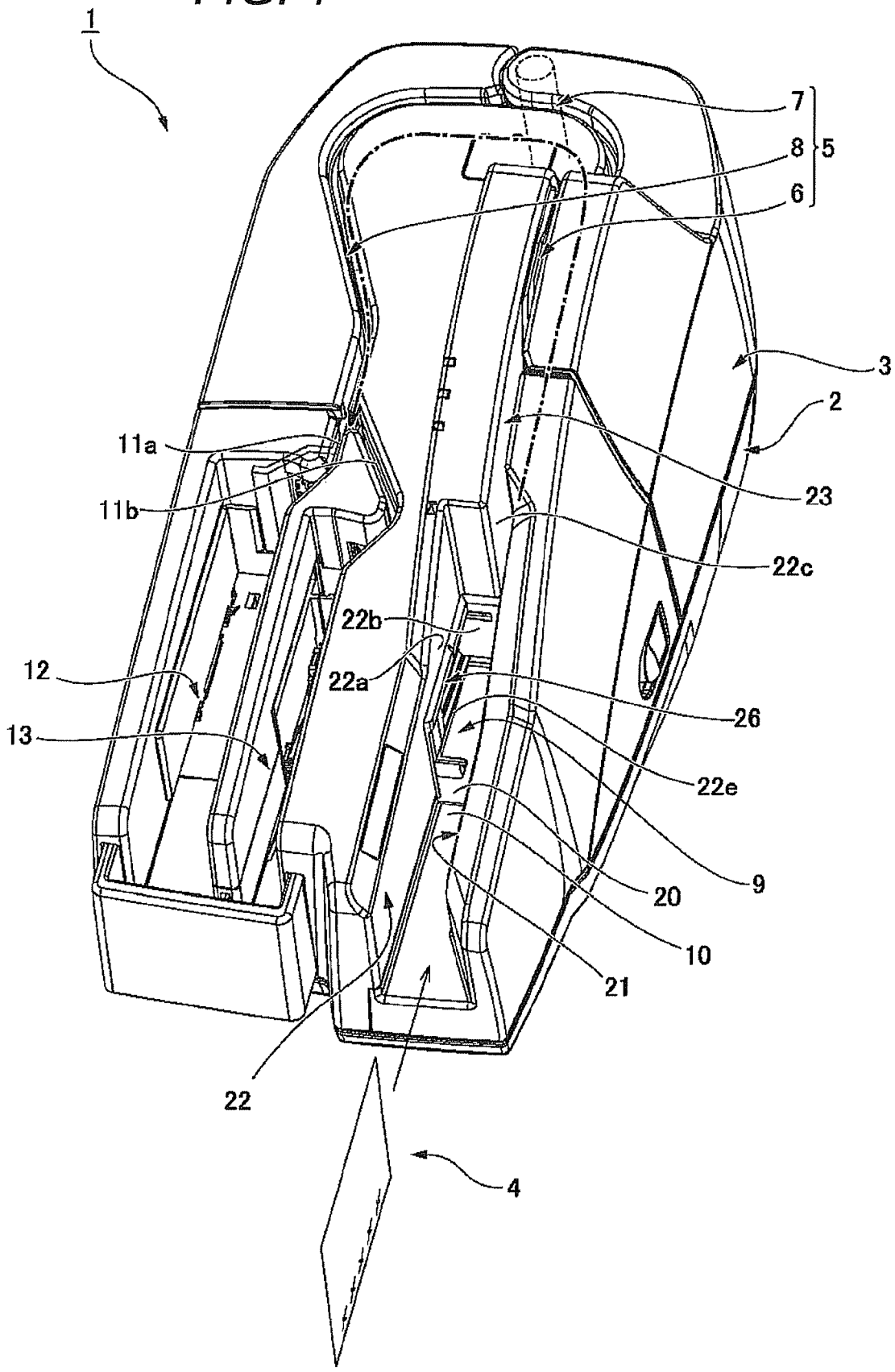
FIG. 1 is a perspective view illustrating an appearance of a check processing apparatus to which the invention is applied.
Figure 2:
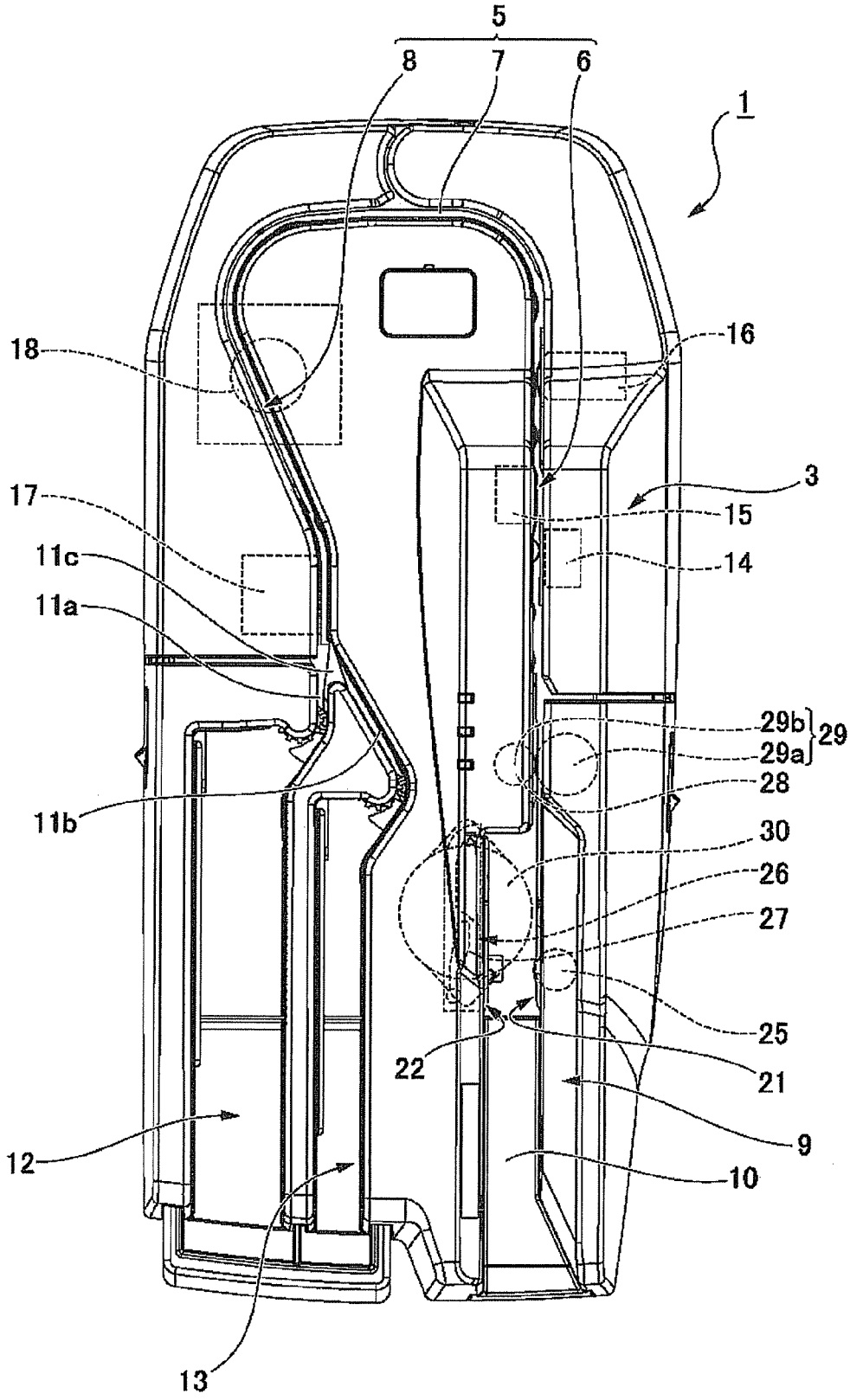
FIG. 2 is a plan view illustrating the check processing apparatus shown in FIG. 1.

FIG. 1 is a perspective view illustrating an appearance of a check processing apparatus according to the present embodiment of the invention. FIG. 2 is a plan view illustrating this check processing apparatus. As shown in FIG. 1, a check processing apparatus 1 includes a body case 2 and a cover case 3 with which the body case 2 is capped. A transport passage 5 for transporting a check 4 (sheet-shaped medium), which is constituted by a vertical groove having a small width, is formed in the cover case 3. The transport passage 5 is substantially cross-sectionally U-shaped, as viewed from above in FIG. 2, and includes a linear upstream transport passage portion 6, a curved transport passage portion 7 that is continuous with the upstream transport passage portion 6, and a slightly curved downstream transport passage portion 8 that is continuous with the curved transport passage portion 7.

A check delivery apparatus 9 is disposed upstream from the upstream transport passage portion 6. The check delivery apparatus 9 includes a check insertion portion 10 constituted by a vertical groove having a large width. The checks 4 inserted into the check insertion portion 10 are delivered to the upstream transport passage portion 6 one by one. The downstream end of the downstream transport passage portion 8 is connected to a first check discharge portion 12 and a second check discharge portion 13, each of which is constituted by a vertical groove having a large width, via branching passages 11*a* and 11*b* that branch leftwardly and rightwardly, respectively, as viewed in these figures.

As illustrated in FIG. 2, a front-surface-side scanner 14 for reading an image (front surface image) printed on the front surface of the check 4, and a rear-surface-side scanner 15 for reading an image (rear surface image) printed on the rear surface of the check 4 are disposed on an upstream transport passage portion 6. A magnetic head 16 for reading a magnetic ink character printed on the check 4 is disposed downstream the rear-surface-side scanner 15. Further, a print mechanism 17 is disposed on a downstream transport passage portion 8. The print mechanism 17 is configured to be driven by a drive motor (not shown) to be movable between a printing position, at which the print mechanism 17 is pressed by the check 4, and a waiting position to which the print mechanism 17 is retreated from the printing position. Further, a switching plate

11*c* is disposed at a branching point between branching passages 11*a* and 11*b*. Checks 4 are distributed by switching the switching plate 11*c*.

(Control System)

Figure 3:
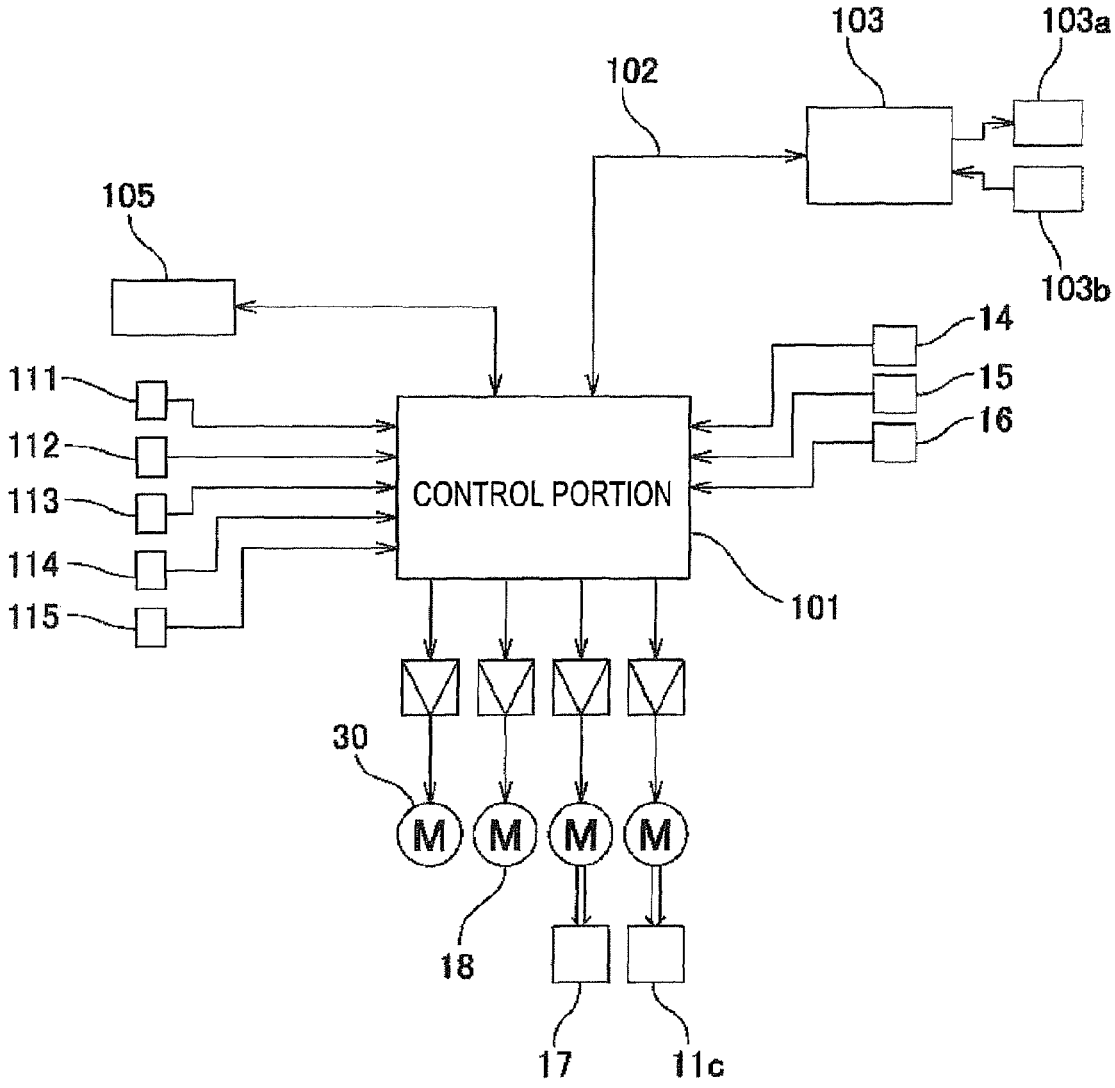
FIG. 3 is a schematic block view illustrating a control system of the check processing apparatus shown in FIG. 1.

FIG. 3 is a schematic block view illustrating a control system of the check processing apparatus 1 shown in FIG. 1. A control system of the check processing apparatus 1 includes a control portion 101 that has a read-only memory (ROM) and a random access memory (RAM) and a central processing unit (CPU). The control portion 101 is connected to a host computer system 103 via a communication cable 102. The computer system 103 includes input/output devices, such as a display device 103*a*, and an operating portion 103*b* including a keyboard and a mouse. For example, an instruction to start a check reading operation is input from the computer system 103 to the control portion 101.

When receiving the instruction to start a reading operation from the computer system 103, the control portion 101 drives a driving motor 30 for delivering a check 4 from a check insertion portion 10, and a transport motor 18 for transporting the check 4 along a transport passage 5. Thus, checks 4 are delivered to the transport passage 5 sheet by sheet. The delivered check 4 is transported along the transport passage 5. Front-surface image information, rear-surface image information and magnetic ink character information read from each check 4 by the front-surface-side scanner 14, the rear-surface-side scanner 15, and the magnetic head 16 are input to the control portion 101. The input information is supplied to the computer system 103, in which image processing and character recognition processing are performed. Further, the control portion 101 determines whether the reading of information is normally performed. The control portion 101 controls the driving of the print mechanism 17 and the switching plate 11*c* based on a result of the determination. Information on the check 4 determined to be normally read is printed by the print mechanism 17. Then, the check 4 determined to be normally read is discharged to the first check discharge portion 12. The check 4 determined not to be normally read is discharged to the second check discharge portion 13.

The conveyance of the check 4 is controlled by the control portion 101, based on detection signals received from various sensors disposed about the transport passages including at least one of a paper length detector 111, an overlapping feed detector 112, a jam detector 113, a print detector 114, and a discharge detector 115. Optionally, an operating portion 105 including an operating switch, such as a power switch formed in the body case 2, is connected to the control portion 101.

(Check Processing Operation)

Figure 4:
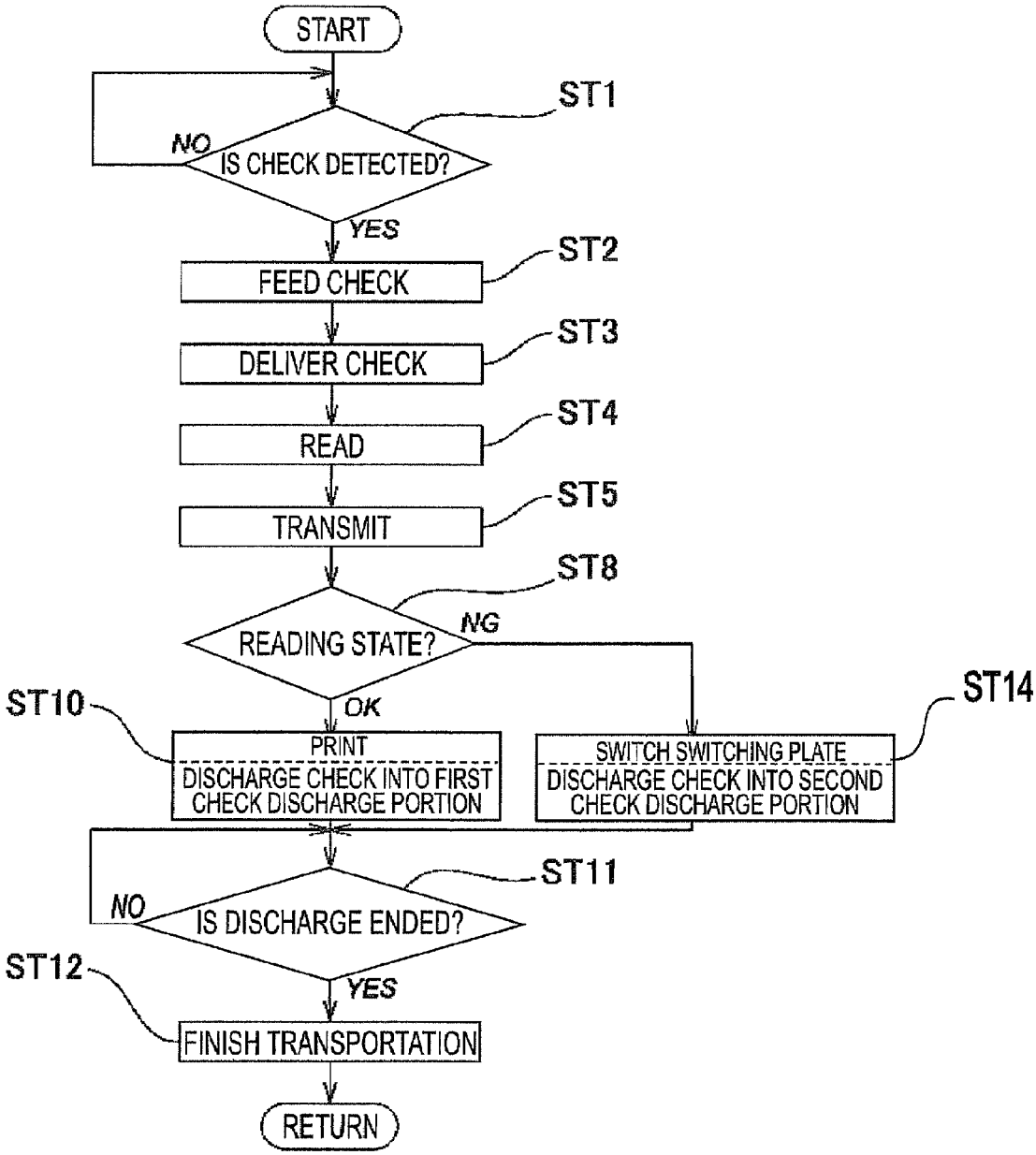
FIG. 4 is a schematic flowchart illustrating a check processing operation of the check processing apparatus shown in FIG. 1.

FIG. 4 is a schematic flowchart illustrating a check processing operation of the check processing apparatus 1. First, when an operator receives from the operating portion 103*b* of the host computer system 103 an instruction to start a reading operation, in step ST1, the check processing apparatus 1 detects whether a check 4 is inserted in the check insertion portion 10. After detecting that a check 4 is inserted therein, in step ST2, the check processing apparatus 1 starts an operation to separate checks 4 sheet by sheet from the check insertion portion 10 and to deliver the separated check 4 to the transport passage 5.

In step ST3, the delivered check 4 is conveyed along the transport passage 5. In step ST4, a front surface image, a rear surface image, and a magnetic ink character of the conveyed check 4 are read by the front-surface-side scanner 14, the rear-surface-side scanner 15, and the magnetic head 16, respectively.

In step ST5, read information is transmitted to the host computer system 103 via the communication cable 102. Information on the read front surface image, the read rear surface image, and the read magnetic ink character information are processed in the computer system 103. The control portion 10 determines whether the reading of each check 4 is normally performed. In a case where a check 4 is conveyed upside down, the magnetic ink character cannot be recognized. Thus, the control portion 101 determines that a magnetic-ink-character reading failure occurs. In a case where a check 4 is conveyed inside up, no magnetic ink character information is obtained. Thus, the control portion 101 determines that no magnetic-ink-character can be read. Further, in a case where a part of magnetic ink characters cannot be read, e.g., where a check 4 is folded, where a check 4 is partially torn, or where a check 4 is skewed while the check 4 is conveyed, the control portion 101 determines also that no magnetic-ink-character can be read. Moreover, in a case where predetermined information, such as money amount information, cannot be recognized from the front surface image information and the rear surface image information because a check 4 is folded, or skewed while the check 4 is conveyed, the control portion 101 determines also that no magnetic-ink-character can be read.

If the control portion 101 determines in step ST8 that the reading of each check 4 is normally performed, the print mechanism 17 is moved to the printing position in step ST10. Then, the expression "electronic payment has been made" or the like is printed on the check 4 by the print mechanism 17. Subsequently, in step ST11, the check 4 is discharged to the first check discharge portion 12 by the switching plate 11*c*. Subsequently, in step ST12, the transportation of the checks 4 is finished.

On the other hand, if the result of the determination made in step ST8 is that a magnetic-ink-character reading failure occurs, or that a part of magnetic ink characters cannot be read, in steps ST14 and ST11, the switching plate 11*c* is switched. The print mechanism 17 is held at the waiting position and printing is not performed on the check 4. Then, the check 4 is distributed and discharged by the switching plate 11*c* to the second check discharge portion 13. Subsequently, in step ST12, the transportation of the checks 4 is finished.

(Check Delivery Apparatus)

Figure 5:
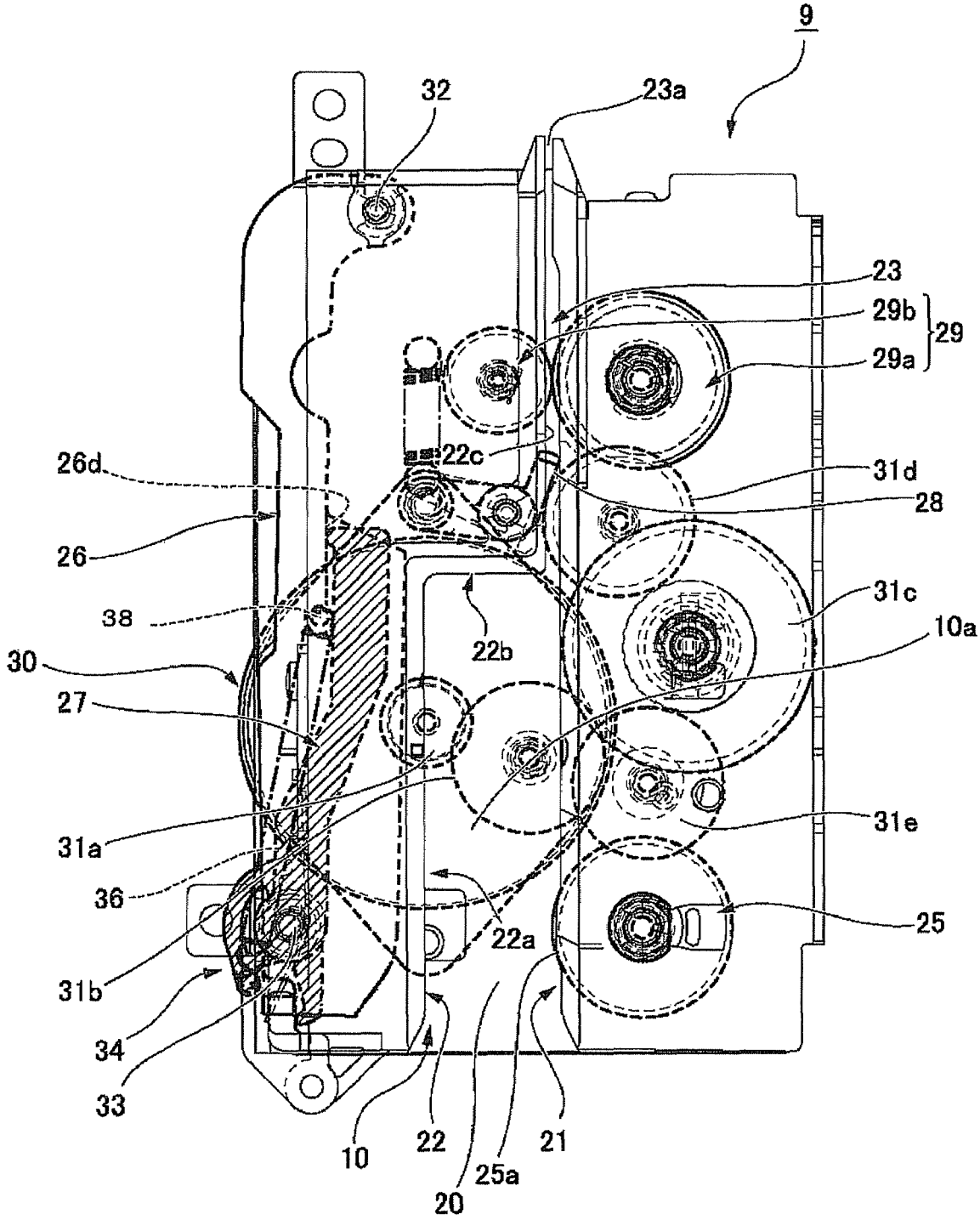
FIG. 5 is a schematic view illustrating a configuration of the check delivery apparatus.

Next, FIG. 5 is a schematic view illustrating a configuration of the check delivery apparatus 9 having the check insertion portion 10.

First, the check insertion portion 10 of the check delivery apparatus 9 is defined by a pair of left-side and right-side medium guide surfaces opposed to each other, i.e., a first medium guide surface 21, and a second medium guide surface 22, and a bottom surface 20. The first medium guide surface 21 has a substantially flat vertical surface. The second medium guide surface 22 includes a parallel guide surface portion 22*a* arranged substantially in parallel with and at a uniform distance from the first medium guide surface 21, an orthogonal guide surface portion 22*b* bending from a front end of the parallel guide surface portion 22*a* towards first medium guide surface 21 at substantially 90 degrees, and a parallel guide surface portion 22*c* extending from an end of the orthogonal guide surface portion 22*b* to face the first medium guide surface 21 substantially in parallel therewith at a narrow distance therefrom.

A wide check accommodating portion 10*a*, into which a check 4 is inserted, is defined by the parallel guide surface portion 22*a* of the second medium guide surface 22 and a part of the first medium guide surface 21, which faces the parallel guide surface portion 22*a*. The width of a leading end of the check accommodating portion 10*a* is narrowed by the orthogonal guide surface portion 22*b*. A check delivery passage 23 having a substantially constant narrow width is defined at the end portion of the check accommodating portion 10*a* by the delivery-passage-side parallel guide surface portion 22*c* and a part of the first medium guide surface 21, which faces the delivery-passage-side parallel guide surface portion 22*c*. An end portion of the check delivery passage 23 has a check delivery port 23*a* connected to the transport passage 5.

Figures 6A, 6B, 6C:
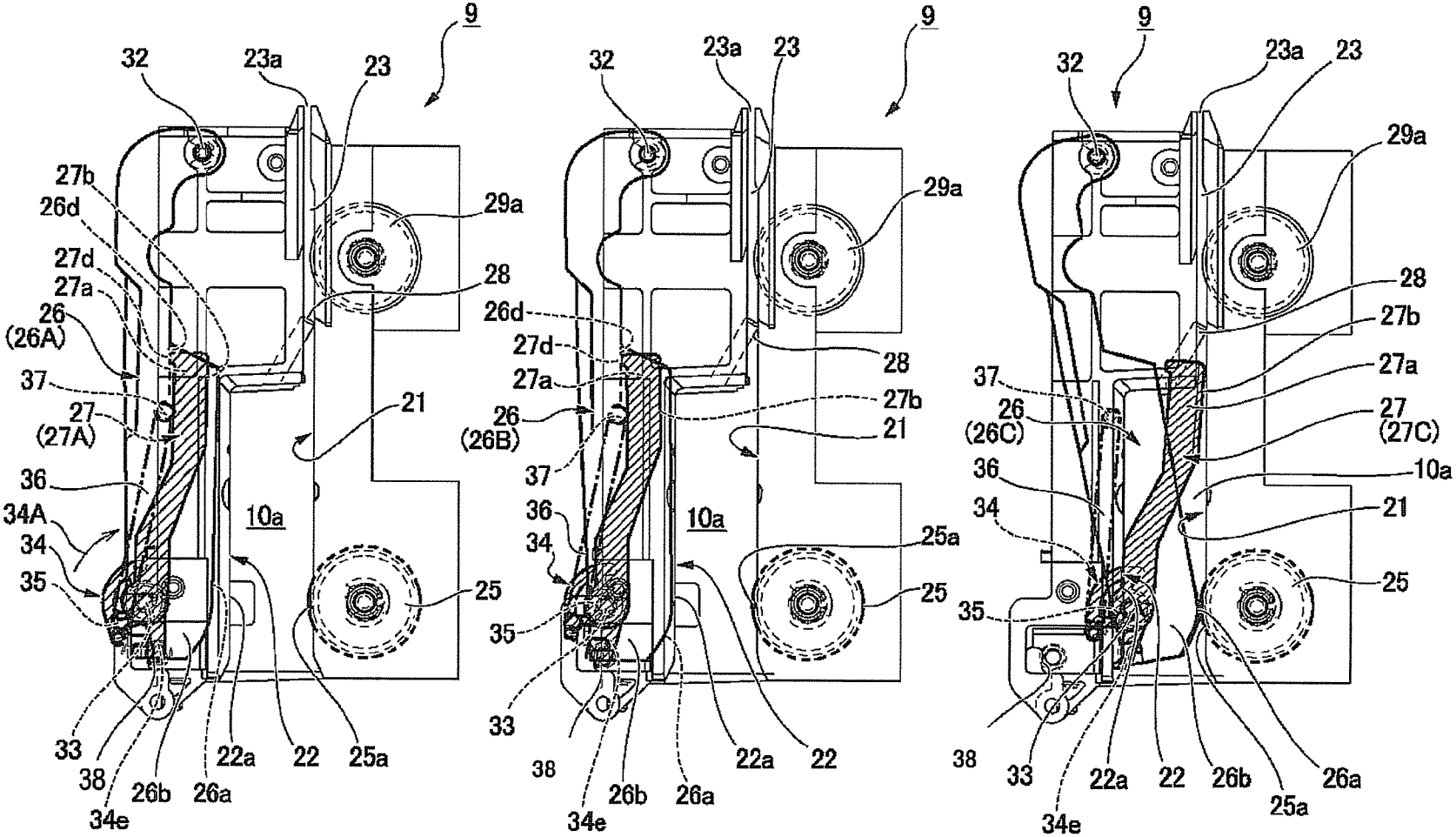
FIGS. 6A to 6C are explanatory views illustrating operations of first and second pressing members.

Next, the check delivery apparatus 9 includes a feed roller 25 for feeding the check 4, a first pressing member 26 for pressing the check 4 against the feed roller 25, and the second pressing member 27 for pressing the check 4 against the first medium guide surface 21 interlockingly with the first pressing member 26 (also see FIG. 6C). In FIG. 5, the second pressing member 27 is indicated with a shaded pattern to display the contour of the second pressing member 27. The check delivery apparatus 9 also includes a separation pad 28 and a separation roller pair 29 for delivering the checks 4, which are fed by the feed roller 25 to the check delivery passage 23, then to the transport passage 5 sheet by sheet.

The feed roller 25 is disposed at a middle part in a check delivering direction of the first medium guide surface 21 so that an outer peripheral surface 25*a* thereof is slightly protruded from the first medium guide surface 21 into the check insertion portion 10. An opening portion 22*e* (see FIG. 1) is formed in the parallel guide surface portion 22*a* of the second medium guide surface 22 opposed to the feed roller 25 To enable the first pressing member 26 to retreat via the opening portion 22*e*. Further, the second pressing member 27 is interlockingly coupled to the first pressing member 26.

When a check 4 is delivered, the first pressing member 26 moves so as to press the check 4 inserted into the check insertion portion 10 against the feed roller 25. Further, the second pressing member 27 moves to press a leading-end portion, in the delivering direction, of the check 4 against the first medium guide surface 21 at the side of the feed roller 25. When the feed roller 25 rotates in this state, the check 4 contacted by the feed roller 25 is fed to the check delivery passage 23. This check 4 is further supplied to the transport passage 5 via this check delivery passage 23. Here, the leading-end portions in the delivering direction of the checks 4 are aligned with one another towards the check delivery passage 23.

Next, the separation pad 28 is constantly urged in a rotation direction, in which the separation pad 28 moves into the check delivery passage 23, by the spring force of a spring. A leading end of the separation pad 28 is pressed against the first medium guide surface 21 in the check delivery passage 23. The separation pad 28 is maintained in a state in which the check delivery passage 23 is blocked up. The check 4 passes through the check delivery passage 23 as a leading-end portion of the check 4 is delivered by the feed roller 25 while the check pushes out the separation pad 28. At that time, the checks 4 are separated into individual sheets. The separation roller pair 29 arranged downstream the separation pad 28 includes a separation roller 29*a*, which is disposed on the side of the first medium guide surface 21, and a retard roller 29*b* disposed on the opposite side. The retard roller 29*b* is pressed against an outer peripheral surface of the separation roller 29*a* by a predetermined pressure. A torque limiter (not shown) gives rotational load torque, which is directed in the check delivering direction, to the retard roller 29*b*. The checks 4 that are not separated into individual sheets by the separation pad 28 can be almost completely individually separated by the separation roller 29*a* and the retard roller 29*b*.

The separation roller 29*a* is rotationally driven by the driving motor 30. As illustrated in FIG. 5, the rotation of the driving motor 30 is transmitted from a driving gear 31*a* via gears 31*b* and 31*c* and a transmitting gear 31*d* to the separation roller 29*a*. The driving motor 30 is used also as a rotary drive source for the feed roller 25. The rotation of the driving motor 30 is transmitted to the feet roller 25 via the driving gear 31*a*, the gears 31*b* and 31*c*, and a transmitting gear 31*e*.

(First Pressing Member and Second Pressing Member)

FIG. 6A illustrates a state in which the first pressing member 26 and the second pressing member 27 are placed at the waiting position and the retreating position, respectively. FIG. 6B illustrates a state in which the first pressing member 26 rotates by a predetermined amount towards the medium pressing position. FIG. 6C illustrates a state after the first pressing member 26 and the second pressing member 27 rotate to the medium pressing position and the protruding position, respectively. In these figures, the second pressing member 27 is indicated with a shaded pattern to display the second pressing member 27.

Referring to these figures, the first pressing member 26 is rotatably supported by the first vertical support shaft 32, which is disposed at a vicinal position at the downstream side of the check delivery passage 23 in a horizontal direction. The first pressing member 26 is rotatably supported between a waiting position 26A, which retreats from the parallel guide surface portion 22*a* of the second medium guide surface 22, as illustrated in FIG. 6A, and a medium pressing position 26C illustrated in FIG. 6C, at which the first pressing member 26 protrudes into the check accommodating portion 10*a* of the check insertion portion 10 and can press the check 4 against the outer peripheral surface 25*a* of the feed roller 25.

The second pressing member 27 is rotatably supported by a second vertical support shaft 33, which is attached to a rotating-member end portion 26*b* of the first pressing member 26, in a horizontal direction. The second pressing member 27 is rotatably supported between a retreating position 27A illustrated in FIG. 6A, at which the second pressing member 27 is drawn into the first pressing member 26, and a protruding position 27C, at which a leading end portion 27*a* protrudes from the first pressing member 26 by a predetermined amount, as illustrated in FIG. 6C. When the first pressing member 26 rotates to the medium pressing position 26C, the leading end portion of the check 4 is pressed against the first medium guide surface 21 by the guide surface 27*b*, at the leading end of the second pressing member 27 placed at the protruding portion 27C.

The first pressing member 26 is rotationally driven by the driving motor 30 (see FIG. 5). In a case where the driving motor 30 is a stepping motor, the rotation position of the first pressing member 26 can be controlled on the basis of the number of steps.

The waiting position 26A of the first pressing member 26 is detected by a sensor (not shown) such as a mechanical switch attached to the body of the apparatus. Further, for example, an operation of pressing the first pressing member 26 against the check 4 inserted into the check insertion portion 10 is permitted in a case where the check 4 is detected by a transmission-type optical sensor (not shown), which is attached to the check insertion portion 10. In a case where the check 4 is detected, the driving motor is driven based on an instruction issued from the computer system 103 (see FIG. 3), which is an examplar host equipment of the check processing apparatus 1, or an instruction input manually by operating an operating button of the check processing apparatus 1. Thus, the first pressing member 26 rotates from the waiting position 26A towards the feed roller 25 to form a state in which the check 4 is pressed against the feed roller 25.

On the other hand, the second pressing member 27 rotates to the retreating position 27A and the protruding position 27C interlockingly with a rotating operation of the first pressing member 26. The mechanism for interlocking with the second pressing member 27 is explained below.

Figure 7A:
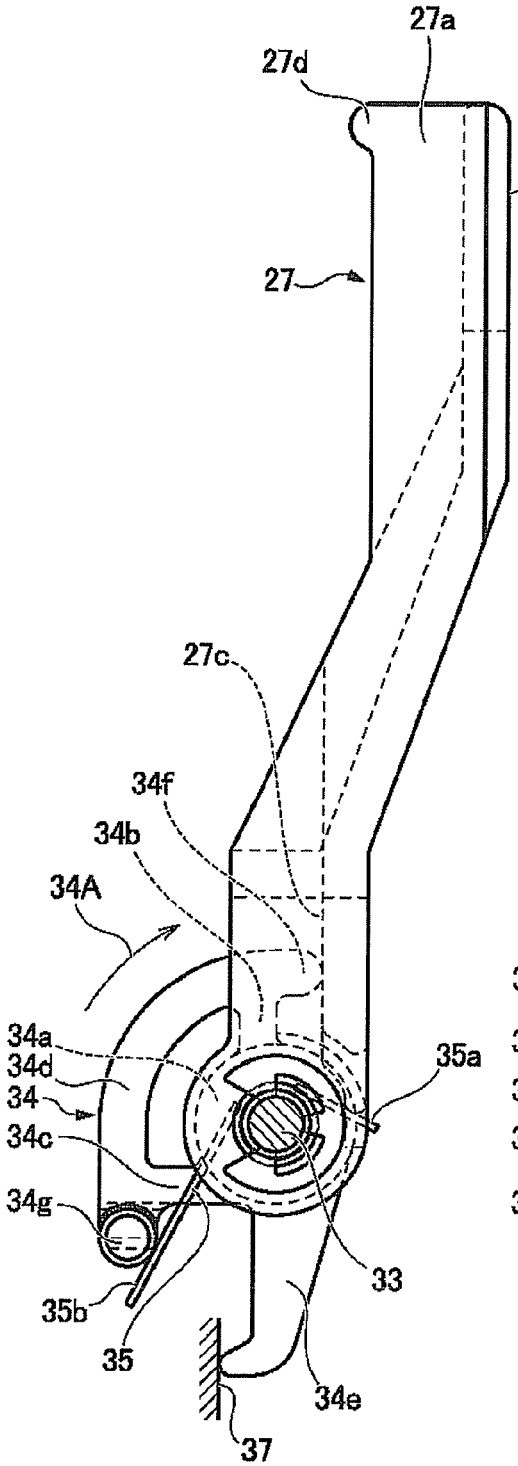
FIGS. 7A and 7B are explanatory views each illustrating a configuration of the second pressing member.
Figure 7B:
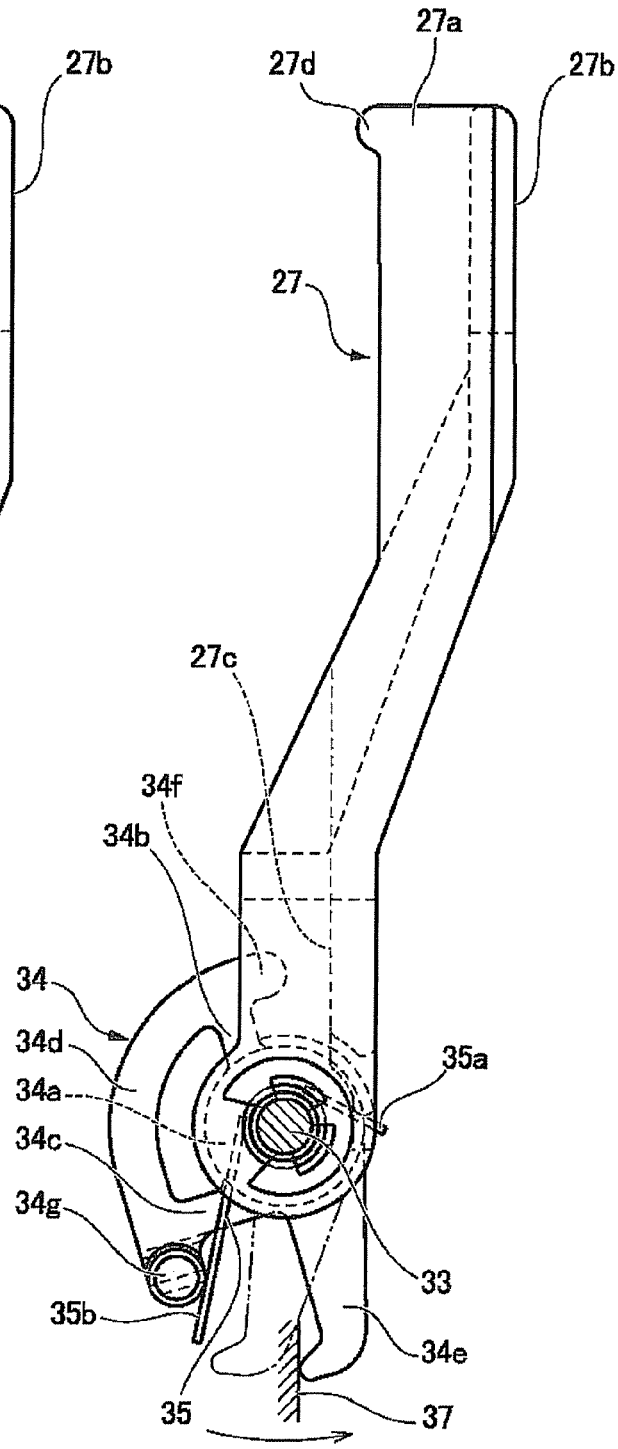

FIGS. 7A and 7B illustrates a side portion extracted from the second pressing member 27 capable of rotating around the second vertical support shaft 33. Referring also to these figures, as described previously, the second pressing member 27 can rotate around the second vertical shaft 33 attached to the first pressing member 26. A rotating member 34 capable of rotating around the second vertical support shaft 33 is attached to the second vertical support shaft 33. Further, a torsion coil spring 35 is wound around the second vertical support shaft 33 such that one end 35*a* of the torsion coil spring 35 is latched onto the second pressing member 27, while the other end 35*b* is latched onto the rotating member 34.

The rotating member 34 includes a disk-like ring portion 34*a* rotably mounted on the second vertical support shaft 33, projecting arms 34*b* and 34*c* protruded outwardly from the ring portion 34*a* at angular intervals of about 90 degrees, a circular-arc portion 34*d* forming an angle of substantially 90 degrees so as to connect the leading ends of the projecting arms 34*b* and 34*c*, and an engaging arm 34*e* outwardly protruded from the ring portion 34*a*. The projecting arm 34*b* extends in the check delivering direction with respect to the second vertical shaft 33, while the engaging arm 34*e* extends in the opposite direction.

An end portion of the circular-arc portion 34*d* of the rotating member 34, which is provided at the side of the second pressing member 27, is formed as a first engaging arm 34*f* protruded from the projecting arm 34*b* in a circumferential direction. A second abutting portion 27*c* is formed at a part at the side of the second pressing member 27 that faces the first engaging arm 34*f*. The first engaging arm 34*f* is maintained in a state, in which the first engaging arm 34*f* abuts against the second abutting portion 27*c*, by the spring force of the torsion coil spring 35. Thus, the rotating member 34 and the second pressing member 27 are interlocked with each other as one unit. Consequently, each of the rotating member 34 and the second pressing member 27 can rotate around the second vertical support shaft 33.

Further, the other end of the circular-arc portion 34*d* of the rotating member 34 protrudes in the circumferential direction from the projecting arm 34*c*. A spring peg 34*g* is formed at this protruded end. As is shown in FIG. 6, one end of the tension coil spring 36 is hooked to the spring peg 34*g*. The tension coil spring 36 extends substantially in the check delivery direction. The other end of the tension coil spring 36 is hooked to a spring peg 38 formed at a part at the side of the body of the apparatus. The rotating member 34 is constantly urged by the spring force of the tension coil spring 36 in the direction of a first rotation direction 34A (i.e., a direction in which the second pressing member 27 is protruded) indicated by an arrow.

Thus, the rotating member 34 is held in an abutting state in which the rotating member 34 is caused by the torsion coil spring 35 to abut against the second pressing member 27. The rotating member 34 is costantly urged by the tension coil spring 36 to the second pressing member 27. Accordingly, as illustrated in FIG. 7A, the rotating member 34 is held in the abutting state in which the rotating member 34 abuts therearound against. Thus, the rotating member 34 and the second pressing member 27 can be rotated in the first rotation direction 34A in an integrated manner.

Further, a protrusion 27*d* protruded in a retreating direction is formed at the rotating-member-side end portion 27*a* of the second pressing member 27. As illustrated in FIGS. 6A to 6C, a first abutting portion 26*d*, against which the projection 27*d* can abut, is formed at a part at the side of the first pressing member 26 which faces the projection 27*d*. The retreating position 27A of the second pressing member 27 is defined by causing the projection 27*d* against the first abutting portion 26*d*. Accordingly, the second pressing member 27 is adapted not to be further rotated in the retreating direction when the projection 27*d* abuts against the first abutting portion 26*d*.

Next, a stationary abutting portion 37 is formed at a vicinal position of the rotating-member-side leading end portion 26*b* of the first pressing member 26 at the side of the body of the apparatus, as illustrated in FIG. 6C. The stationary abutting portion 37 is placed on the movement locus of the leading end portion of the engaging arm 34*e* of the rotating member 34 that moves with the rotation of the first pressing member 26. Thus, as illustrated in FIGS. 6B and 7A, the leading end portion of the engaging arm 34*e* of the rotating member 34 abuts against the stationary abutting portion 37 at the rotating position 26B of the first pressing member 26 on the return way from the medium pressing position 26C to the waiting position 26A. Moreover, the abutting state, in which the engaging arm 34*e* and the stationary abutting portion 37 abut against each other, is maintained while the first pressing member 26 is placed between the rotating position 26B and the waiting position 26A. Consequently, in a state in which the first pressing member 26 is placed at the waiting position 26A, the rotating member 34 is brought into a condition in which the rotating member 34 is forcibly rotated by a predetermined amount in a direction opposite to the first rotation direction 34A, as illustrated in FIGS. 6A and 7B.

(Check Delivering Operation)

Figure 8:
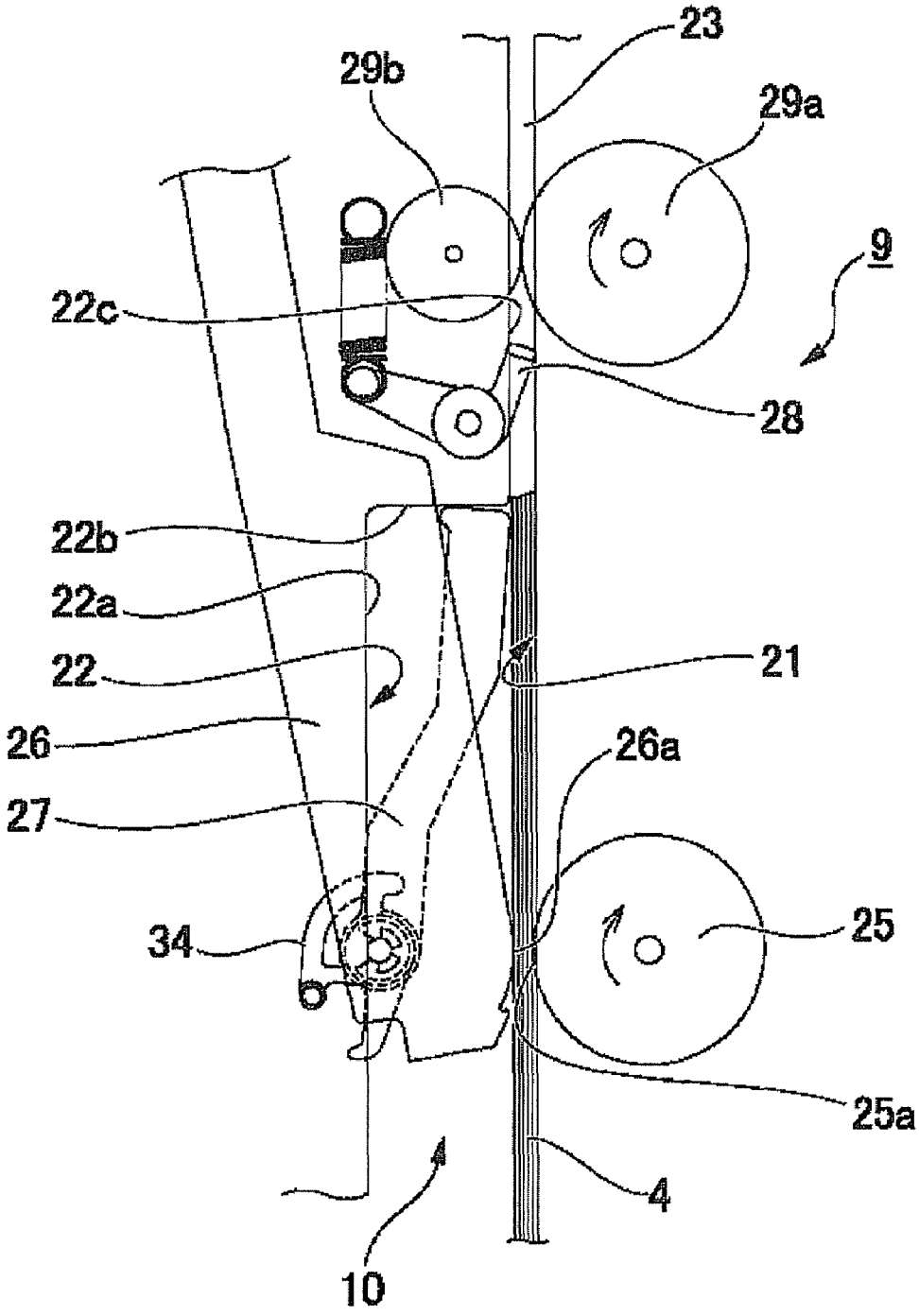
FIG. 8 is an explanatory view illustrating a check delivering operation.

FIG. 8 illustrates a check delivery operation of the check delivery apparatus 9. A check delivery operation of the check delivery apparatus 9 is described hereinafter with reference to FIGS. 6A to 6C, 7A and 7B, and 8 by focusing on operations of the first pressing member 26 and the second pressing member 27.

First, the first pressing member 26 and the second pressing member 27 are in a state illustrated in FIGS. 6A and 7B. In this state, the rotating member 34 rotates by the stationary abutting portion 37 in a direction opposite to the first rotation direction 34A, so that the first engaging arm 34*f* is spaced apart from the first abutting surface 27*d* of the second pressing member 27.

When the checks 4, which are in a stacked state, are inserted into the check insertion portion 10, a sensor (not shown) detects that the checks 4 are inserted thereinto. When the driving motor 30 is driven in response to an instruction received from the host equipment or a manual operation input, the first pressing member 26 protrudes into the check insertion portion 10 and starts rotating in a direction in which the first pressing member 26 presses the checks 4 against the feed roller 25.

When the first pressing member 26 is rotated around the first vertical support shaft 32 from the waiting position 26A to the medium pressing position 26C, the rotating member 34 mounted on the first pressing member 26 also moves in a direction in which the rotating member 34 goes away from the stationary abutting portion 37. At that time, the rotating member 34 gradually returns in the first rotation direction 34A by rotating around the second vertical support shaft 33. Thus, the rotating member 34 gradually approaches the second pressing member 27. In this state, the second pressing member 27 is held in the retreating position 27A, at which the second pressing member 27 abuts against the first pressing member 26, without rotating.

When the first pressing member 26 rotates therearound by a predetermined amount, the rotating member 34 abuts against the second pressing member 27, as illustrated in FIGS. 6B and 7A. Then, the rotating member 34 reaches a position at which the rotating member 34 is disengaged from the stationary abutting portion 37. In the present embodiment, at this time point, this position is the rotating position just before the first pressing member 26 protrudes into the check insertion portion 10. The second pressing member 27 is still placed at the retreating position 27A at which the second pressing member 27 is accommodated by the first pressing member 26.

When the first pressing member 26 is further rotated to the medium pressing position 26C, the rotating member 34 is disengaged from the stationary abutting portion 37. Then, the rotating member 34 is rotated around the second vertical support shaft 33 in the first rotation direction 34A by the spring force of the tension coil spring 36. The rotating member 34 is held by the torsion coil spring 35 in the abutting state in which the rotating member 34 abuts against the second pressing member 27. Thus, the second pressing member 27 starts rotating from the retreating position 27A to the protruding position 27C together with the rotating member 34.

Subsequently, the first pressing member 26 moves to the medium pressing position 26C at which the first pressing member 26 can press the checks 4 against the feed roller 25. Further, the second pressing member 27 moves to the protruding position 27C at which the second pressing member 27 can press a leading end portion in the direction of delivering one of the checks 4 thereof against the first medium guide surface 21. Consequently, as illustrated in FIG. 8, the checks 4 in a bundle inserted into the check insertion portion 10 are pressed at a middle part thereof against the feed roller 25 by the leading end surface 26*a* of the first pressing member 26. Further, the check 4 is pressed at a leading-end portion in the delivering direction thereof by the guide surface 27*b* of the second pressing member 27 against the first medium guide surface 21.

The leading-end portion of the check 4 is pressed by the second pressing member 27 against the first medium guide surface 21. Therefore, even in a case where the leading end portion of the check 4 is creased, the check 4 is pressed against the first medium guide surface 21 without the spread of the leading end portion of the check 4. Thus, the check 4 is not held in a state in which the check 4 abuts against the orthogonal guide surface portion 22*b* of the second medium guide surface 22. Consequently, the check 4 is delivered by being surely guided to the check delivery passage 23 with the feed roller 25.

At a time after the first pressing member 26 starts moving from the waiting position 26A to the medium pressing position 26C, i.e., a time at which the rotating member 34 abuts against the second pressing member 27, the second pressing member 27 starts moving from the retreating position 27A to the protruding position 27C. Accordingly, the time at which the second pressing member 27 starts moving from the retreating position 27A to the protruding position 27C can be easily changed by changing the time at which the rotating member 34 abuts against the second pressing member 27. The time at which the second pressing member 27 starts moving can be adjusted to an appropriate time by adjusting a time at which the engaging arm 34*e* of the rotating member 34 and the stationary abutting portion 37 abut against each other, to increase or decrease an amount of rotation required by the rotating member 34 to abut against the second pressing member 27.

According to the present embodiment, a state in which the first pressing member 26 moves to the medium pressing position 26C and in which the checks 4 are aligned with one another by being pressed against the feed roller 25 is first formed by delaying the time at which the movement of the second pressing member 27 is started. Subsequently, the second pressing member 27 reaches the protruding position 27C to thereby form a state in which the checks 4 are alight with one another by being pressed against the first medium guide surface 21. A central portion of each of the checks 4 or the neighborhood thereof is pressed to preliminarily align the leading end portions of the checks 4 in the direction of delivering thereof with one another. Consequently, even in a case where the leading-end-side portions of the checks 4 are spread, the leading end portions of the checks 4 can surely be aligned with one another. In addition, first, the checks 4 are pressed against the feed roller 25 by the first pressing member 26. Consequently, a state, in which the checks 4 are surely pressed against the outer peripheral surface of the feed roller 25, can be formed. Subsequently, the leading end portions of the checks 4 in the direction of delivering thereof are pressed to be aligned with one another. Accordingly, an operation of delivering the checks 4 can surely be performed.

Next, when the sensor (not shown) detects that the checks 4 are absent therein, the apparatus can determine that the delivery of the checks 4 is finished. Then, an operation of returning the first pressing member 26 from the medium pressing position 26C to the waiting position 26A by the driving motor 30 is performed. At that time, the first pressing member 26 is returned thereto by being rotated around the first vertical support shaft 32. Neither the second pressing member 27 nor the rotating member 34 rotates around the second vertical shaft 33. The second pressing member 27 is maintained by the spring force of the tension coil spring 36 in a state in which the second pressing member 27 is protruded from the first pressing member 26.

When the first pressing member 26 returns to the rotating position 26B illustrated in FIG. 6B, the rotating member 34 abuts against the stationary portion 37. Subsequently, as the first pressing member 26 returns to the waiting position 26A, the rotating member 34 is forcibly rotated in a direction opposite to the first rotation direction 34A. Consequently, the second pressing member 27 also starts returning to the retreating position 27A together with the rotating member 34.

When the second pressing member 27 reaches the retreating position 27A, the leading-end-side projection 27*d* of the second pressing member 27 abuts against the first abutting portion 26*d* at the side of the first pressing member 26. On the other hand, the rotating member 34 abutting against the stationary abutting portion 37 is further forcibly rotated in a direction opposite to the first rotation direction 34A as the first pressing member 26 is rotated to the waiting position 26A. Thus, the rotating member 34 goes away from the second pressing member 27. After the rotating member 34 is spaced apart from the second pressing member 27 by a predetermined amount, the first pressing member 26 returns to the waiting position 26A and is put into a state illustrated in FIGS. 6A and 7B.

Thus, the second pressing member 27 returns to the retreating position 27A at the side of the first pressing member 26. Then, the rotating member 34 rotates interlockingly with the return operation of the first pressing member 26. Accordingly, even in a case where there is a variation in the waiting position 26A of the first pressing member 26, the variation is compensated by an amount of rotation of the rotating member 34. Thus, the second pressing member 27 can be always and surely returned to the retreating position 27A housed in the first pressing member 26. Consequently, even in a case where there is a variation in the waiting position 26A of the first pressing member 26, the second pressing member 27 is not brought into a state in which the second pressing member 27 does not protrude into the check insertion portion 10 from the side of the first pressing member 26. Accordingly, the second pressing member 27 does not become an obstacle when the check 4 is inserted into the medium insertion portion 10. The width of the check insertion portion 10 is not reduced by arranging the second pressing member 27. Thus, the number of the accommodated checks 4 can be assured.

(Control of Speed of First Pressing Member)

Here, preferably, a movement speed at the time of moving the first pressing member 26 from the waiting position 26A to the medium pressing position 26C is set at a low speed (first speed) on the way from the waiting position 26A. Subsequently, the movement speed is changed to a high speed (second speed). Preferably, for example, the first pressing member 26 moves at the low speed up to a time point just before the engaging arm 34*e* of the rotating member 34 is disengaged from the stationary abutting portion 37. Subsequently, the movement speed is accelerated to move the first pressing member 26 at the high speed.

Figure 9:
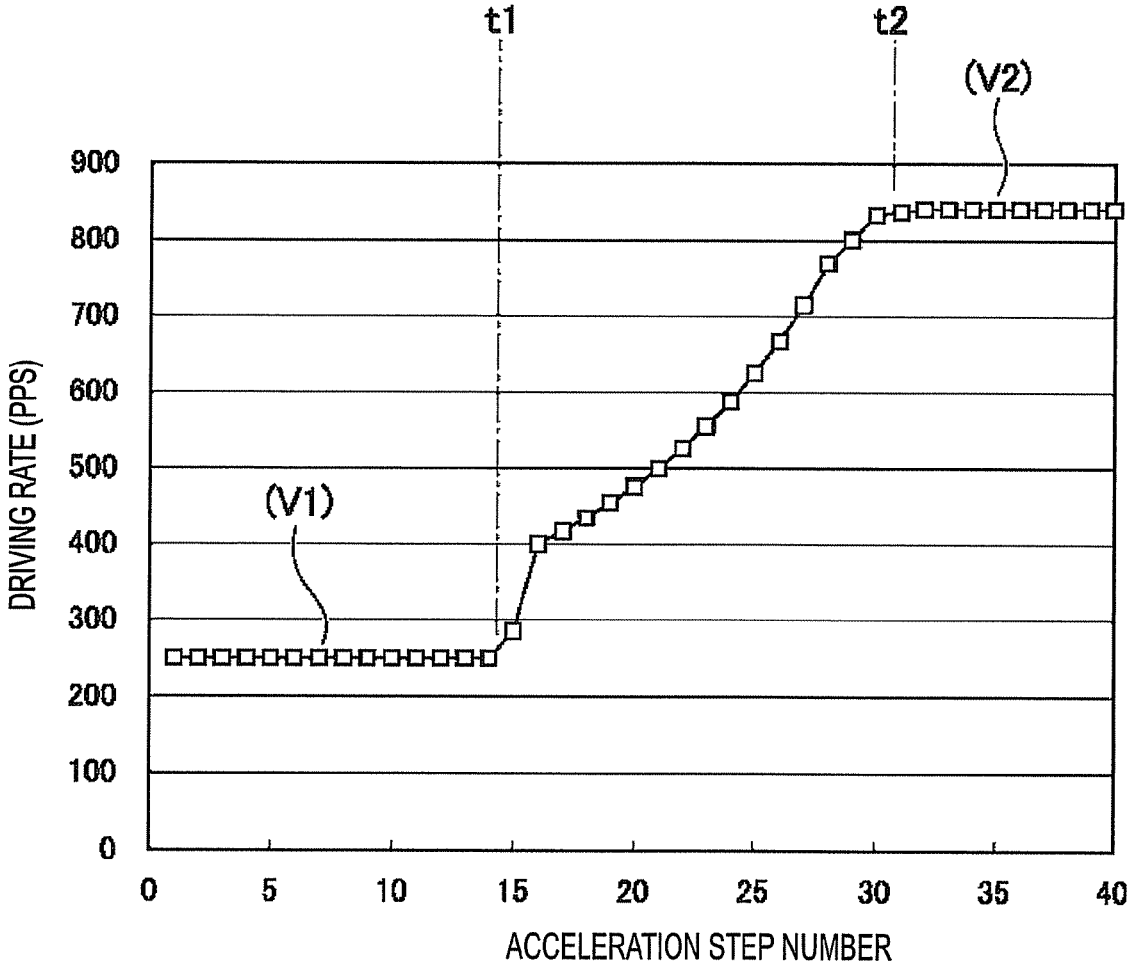
FIG. 9 is a graph illustrating an example of controlling a drive motor of the first pressing member.

In the present embodiment, the driving motor 30 for the first pressing member 26 is preferably a stepping motor. Thus, for example, it is useful to increase the driving rate of the driving motor 30 halfway (time points t1 to t2), as illustrated in FIG. 9, and to change the movement speed of the first pressing member 26 from the low speed V1 to the high speed V2. The driving motor 30 is preferably a direct-current (DC) motor. Further, the driving motor is preferably controlled using an encoder (not shown). Further, the movement speed is preferably steplessly changed from the low speed V1 to the high speed V2.

Figure 10:
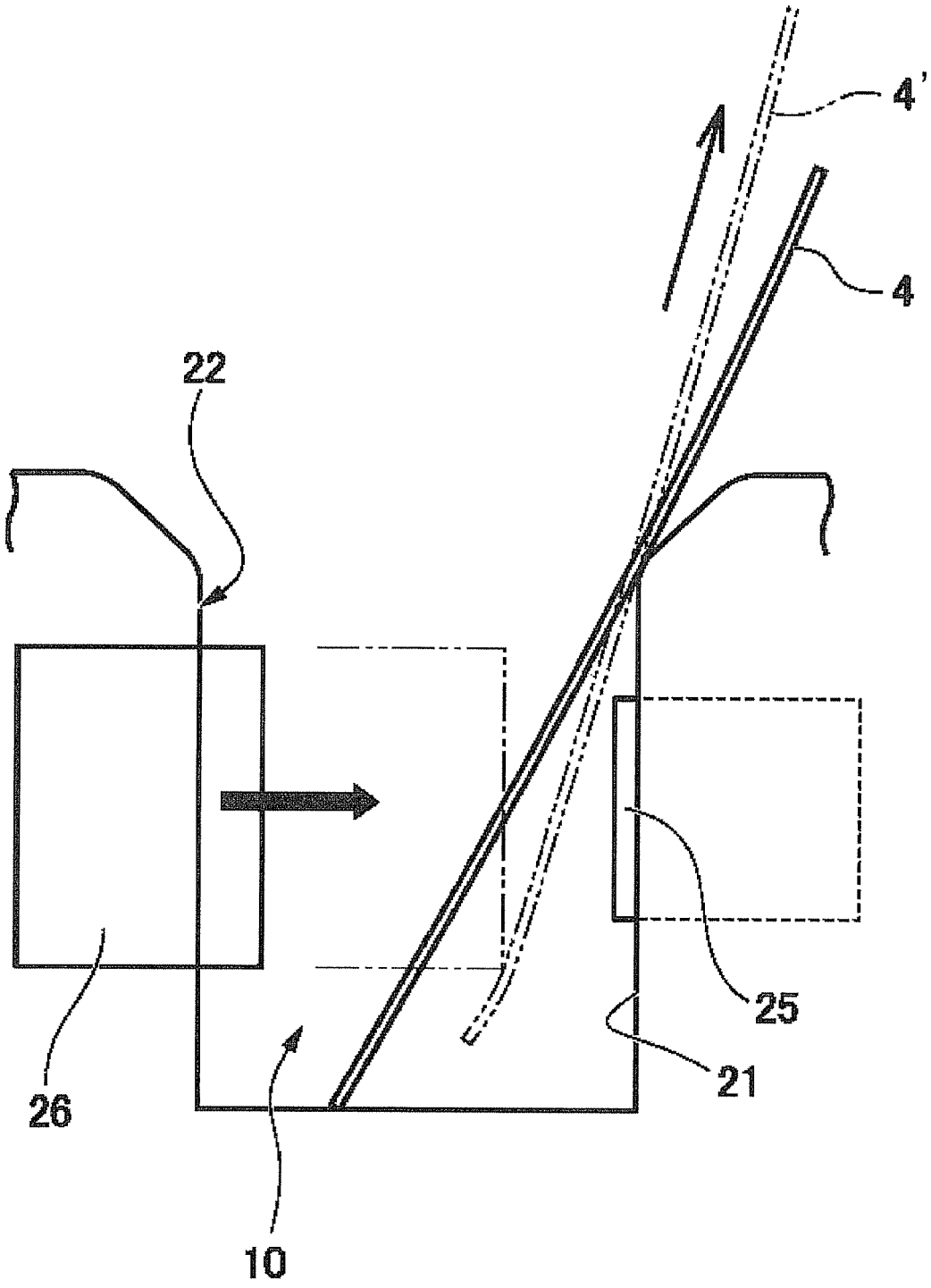
FIG. 10 is an explanatory view illustrating a check pressing operation performed by the first pressing member.

In a case where a small number of the checks 4 inserted in the check insertion portion 10, as illustrated in FIG. 10, the checks 4 are laid obliquely on the first medium guide surface 21 on which the feed roller 25 is arranged. When the checks 4 in this state are pushed to the first medium guide surface 21 by moving the first pressing member 26 at the high speed thereto from the side of the second medium guide surface 22, the checks 4 are obliquely upwardly pushed with power of the first pressing member 26. Thus, the checks 4 are transported by being pressed against the feed roller 25 in a wholly floated-up state (4'). Such a state often causes a magnetic-ink-character reading failure.

When the first pressing member 26 moves from the waiting position 26A to the medium pressing position 26C, the first pressing member 26 initially moves at the slow first speed. Thus, the checks 4 laid obliquely can be gradually erected by the first pressing member 26, without being floated-up, into a vertically standing state. Subsequently, the check 4 put in the vertically standing state can be pressed against the first medium guide surface 21 at the high speed. Accordingly, the checks 4 can be prevented from being floated up. In addition, the check 4 can be pressed against the feed roller 25 in a short time.

Here, a time at which the movement speed of the first pressing member 26 is changed from the low speed to the high speed can be set at a time that differs from the aforementioned time. For example, the movement speed of the first pressing member 26 can be changed to the high speed by being accelerated after the leading end portion of the first pressing member 26 protrudes into the check insertion portion 10 by a predetermined amount.

Other Embodiments

The foregoing descriptions described an example of using the medium delivery apparatus according to the invention as a check delivery apparatus in a check processing apparatus. The medium delivery apparatus according to the invention can similarly be applied to sheet-shaped medium processing apparatuses, such as a printer, a scanner, and a magnetic reading apparatus, other than the check processing apparatus.

What is claimed is:

1. A medium delivery apparatus, comprising:

a medium insertion portion, into which a medium is to be inserted;

a medium delivery port, from which the medium inserted into the medium insertion portion is to be delivered;

first and second medium guide surfaces, configured to be opposed to each other to guide the medium towards the medium delivery port;

a feed roller, arranged at a side of the first medium guide surface to feed the medium inserted into the medium insertion portion towards the medium delivery port;

a first pressing member, being rotatably supported around a first support shaft arranged at a side of the second medium guide surface, between a waiting position at a side of the second medium guide surface and a medium pressing position at which the first pressing member approaches or abuts against the feed roller;

a second pressing member, being rotatably supported around a second support shaft attached to the first pressing member, between a retreating position to which the second pressing member retreats to a side of the first pressing member and a protruding position at which the second pressing member approaches or abuts against the first medium guide surface;

a rotating member, being rotatably supported around the second support shaft;

an urging member, configured to give an urging force acting in a first rotation direction to the rotating member to rotate the second pressing member toward the protruding position;

an elastic member, configured to cause the second pressing member and the rotating member to abut against each other such that the second pressing member and the rotating member rotate together; and a stationary abutting portion, against which the rotating member abuts when the first pressing member is placed in the vicinity of the waiting position, wherein when the first pressing member is placed at the waiting position, the rotating member abuts against the stationary abutting portion and rotates in a direction opposite to the first rotation direction so as to be spaced at a distance from the second pressing member.

2. The medium delivery apparatus according to claim 1, wherein the second pressing member reaches the protruding position after the first pressing member reaches the medium pressing position.

3. The medium delivery apparatus according to claim 1, wherein:

the first pressing member is provided with a first abutting portion against which the second pressing member can abut, and the retreating position of the second pressing member is determined by the first abutting portion;

the rotating member includes: a first engaging arm extending in a delivering direction, in which the medium is delivered, around the second support shaft; and a second engaging arm extending in a direction opposite to the delivering direction; and the second pressing member is provided with a second abutting portion against which the first engaging arm of the rotating member can abut when the first engaging arm is rotated in the first rotation direction.

4. The medium delivery apparatus according to claim 1, wherein:

the urging member is a tension coil spring laid between the rotating member and the first pressing member in a tension state; and the elastic member is a torsion coil spring wound around the second support shaft, and one end of the torsion coil spring is latched onto the rotating member and the other end is latched onto the second pressing member.

5. The medium delivery apparatus according to claim 1, further comprising:

a drive mechanism configured to rotate the first pressing member to the waiting position and the medium pressing position, wherein the drive mechanism accelerates a movement speed of the first pressing member when the first pressing member moves from the waiting position to the medium pressing position.

6. The medium delivery apparatus according to claim 5, wherein:

the drive mechanism rotates the first pressing member at a first speed when the rotating member abuts against the stationary abutting portion; and the drive mechanism accelerates the movement speed of the first pressing member to a second speed after the rotating member is disengaged from the stationary abutting portion.

7. A medium processing apparatus, comprising the medium delivery apparatus according to claim 1.

* * * * *